US005238069A

United States Patent [19]

Schaefer, Jr. et al.

[11] Patent Number: 5,238,069

[45] Date of Patent: Aug. 24, 1993

[54] SYSTEM FOR PREVENTING CUTTING GAS EXPLOSION DURING SUBTERRANEAN PIPE CUTTING OPERATIONS

[75] Inventors: Louis E. Schaefer, Jr.; David Ross, both of Gretna, La.

[73] Assignee: Superior Offshore Services, Inc.

[21] Appl. No.: 762,939

[22] Filed: Sep. 19, 1991

[51] Int. Cl.[5] ..... E21B 29/12

[52] U.S. Cl. ..... 166/361; 166/356

[58] Field of Search ..... 166/340, 356, 361, 297, 166/298, 55; 405/226

[56] References Cited

U.S. PATENT DOCUMENTS 4,558,744 12/1985 Gibb ..... 166/356 X 4,900,198 2/1990 Hoaki .

FOREIGN PATENT DOCUMENTS 0114721 7/1989 Japan .

*Primary Examiner*—William P. Neuder

*Attorney, Agent, or Firm*—C. Emmett Pugh

[57] ABSTRACT

An apparatus and system designed to prevent cutting gas buildup and explosion of same during the cutting of underwater abandoned wellheads and the like. The present system as configured is primarily designed for use in conjunction with generally longitudinally arranged pipes such as wellhead conductor pipe or the like, and teaches an apparatus configured to slidingly envelope the pipe, having the capability for excavating the area immediately about the pipe such that the apparatus migrates about and down the pipe to a predetermined depth, flushing out the mud about the conductor pipe which sometimes traps cutting torch gas during cutting operations and causes explosions or the like. The present system utilizes a jetting arrangement for the excavation process wherein there is provided a coupling system, a conduit system for conveying pressurized fluid such as water or the like, and a jetting system about the base of the apparatus for the jetting of the soil to the desired depth, and for circulating the pressurized fluid between the apparatus and the outer wall of the conductor pipe once the desired depth is reached and the cutting operation has begun.

3 Claims, 5 Drawing Sheets

SYSTEM FOR PREVENTING CUTTING GAS EXPLOSION DURING SUBTERRANEAN PIPE CUTTING OPERATIONS

BACKGROUND OF INVENTION

1. Field of Invention

The present invention relates to systems for severing subterranean pipes and the like, and in particular to an apparatus and system designed to prevent or at least reduce the buildup of cutting gas and explosion of the same during the cutting of underwater abandoned wellheads and the like.

The present system as configured is primarily designed for use in conjunction with generally longitudinally arranged pipes, such as wellhead conductor pipe or the like, and teaches the use of an apparatus configured to slidingly envelope the pipe, having the capability for excavating the area immediately about the pipe such that the apparatus migrates about and down the pipe to a predetermined depth, flushing out the mud about the conductor pipe which sometimes traps cutting torch gas during cutting operations and causes explosions or the like.

The present preferred system utilizes a jetting arrangement for the excavation process, wherein there is provided a coupling system, a conduit system for conveying pressurized fluid such as water or the like, and a jetting system about the base of the apparatus for the jetting of the soil to the desired depth, and for circulating the pressurized fluid between the apparatus and the outer wall of the conductor pipe once the desired depth is reached and the cutting operation has begun.

2. Prior Art & General Background

Federal law requires that, in abandoning a subsea oil or gas wellhead, the conductor casing be removed to a depth of at least fifteen (15) feet below the mud line so that it does not pose a hinderance to navigation.

In accomplishing this task, divers often must climb into the casing itself to a depth of at least fifteen (15) feet below the mud line, and cut the casing, often utilizing an oxygen/arc cutting torch or like system. This operation is very risky in that gases created by the burning pipe metal combine with residual oxygen from the cutting process to form pockets of gas in the mud surrounding the cutting area. These pockets often ignite and explode, causing death or serious injury to the diver.

Until now, there has been no apparatus which would displace the mud from about the periphery of a subterranean pipe or the like and provide a circulating, fluid current for removing explosive residual gas from the cutting area, preventing gas build-up and the potential for explosion.

U.S. Pat. No. 4,900,198 to Hoaki describes a "Method and Apparatus for removing Old Pile", wherein (note FIG. 1) there is disclosed a "bucket" having a diameter apparently sufficient to slidingly envelope the pile to be removed, and further incorporating water jetting means (elements 19, 23, and 24) for displacing soil to allow the bucket to "travel" in longitudinal fashion down the pile under the mud line, so that it may cut the pile one section at a time for removal.

While the '198 patent is pertinent, it is nonetheless fully distinguishable from the present system, and in fact could not be used with the present system. Indeed, Hoaki teaches an apparatus for removing rotted wood piles or the like, and did not contemplate a system for extended excavation depths and circulation means to above the mud line for preventing explosive build-up of cutting gasses.

Thus, while the prior art may contemplate apparatus and systems for cutting pile and piping, none appear to teach or even suggest a system for providing an optimally safe environment for subterranean pipe removal operations utilizing cutting torches or the like.

3. GENERAL, SUMMARY DISCUSSION OF THE INVENTION

The present invention provides a system for eliminating the problems associated with cutting gas build-up during the removal of subterranean conductor pipes and the like, which is highly reliable, relatively economical to implement, and at a potentially significant cost savings.

While the prior art contemplates a variety of specialized mechanisms and the like for removing casing below the mud-line, these systems traditionally have either been much too expensive to be cost effective, or have failed to work, causing down time and added complications.

It has been found that the only consistent way to remove the conductor pipe at the desired depth below the mud line quickly and relatively cheaply has been to have a diver climb down the pipe to the desired depth and cut the pipe from the inside. However, as indicated above, the residual gasses from the cutting operation sometimes form pockets in the mud, accumulating to a degree which may cause fatal explosions during the cutting operation if ignited.

The present invention is configured to slidingly envelope the conductor casing and is placed about the casing above the mud line. The invention includes in its preferred, exemplary embodiment a tubular main body of about one to six inches greater (1–6"$>$) than the diameter of the conductor pipe, a tapered base, an elongated cylindrical medial area or main body, and an upper base plate.

In use, the invention is placed about the upper perimeter of the conductor pipe and allowed to slide down the pipe until it intersects with the sea floor. Pressurized sea water is then jetted through a jet pipe, exiting at the lower peripheral base of the invention, so that it jets away the soil and debris about the outer periphery of the conductor casing, allowing gravity to draw the base longitudinally down, slidingly enveloping the casing below the mud line.

The main body of the preferred, exemplary embodiment of the present invention is, for example, eighteen feet long, and is allowed to jet until the upper base plate intersects with the sea floor, preventing any further longitudinal migration of the apparatus down the conductor pipe.

After the present system is allowed to reach the desired depth, the water is continued to be jetted through the jet pipe, although it may be at a lesser pressure, thereby venting away any residual gasses escaping the exterior of the pipe during the cutting operation, and preventing or at least reducing gas accumulation and explosion.

Following the cutting operation, the apparatus is removed via lifting cables or the like, leaving the severed conductor pipe for salvage.

Although the present system is taught as utilized in undersea conditions and with water as the pressurized excavation and venting fluid, it is noted that similar problems regarding cutting operations exist on land, and the present system may be utilized in a variety of configurations and with a variety of fluids.

It is thus an object of the present invention to provide a system for preventing the accumulation of gasses exterior to conductor pipes and the like during cutting operations.

It is a further object of the present invention to provide an apparatus which slidingly envelopes pipe, and includes a system for excavating soil and debris from about the periphery of the pipe.

It is a further object of the present invention to provide an apparatus which longitudinally traverses subterranean pipe, slidingly enveloping it to a desired depth.

It is a further object of the present invention to provide a system for maintaining an optimal environment of non-flammable, circulating fluid exterior to an object to be cut, conveying away explosive residual gases created during the cutting process.

It is another object of the present invention to provide a system for preventing residual gas explosion during the subterranean cutting of pipe and the like, utilizing an apparatus which is portably transported to the cutting site, and easily installed and implemented utilizing conventional support equipment and tooling.

It is still another object of the present invention to provide a system for the removal of dangerous gas residue created during removal or maintenance of subterranean pipe or the like, wherein the apparatus may be installed without additional dive support and wherein it may be easily removed and re-utilized without significant retrofitting or maintenance.

It is still another object of the present invention to provide a system for the prevention of cutting gas explosion which may be configured to be utilized for a variety of cutting depths.

Lastly, it is an object of the present invention to provide a system for the prevention of cutting gas build-up and explosion which may be utilized on shore and with a variety of excavation fluids and non-flammable venting gasses.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENTS(S)

Figure 1A:
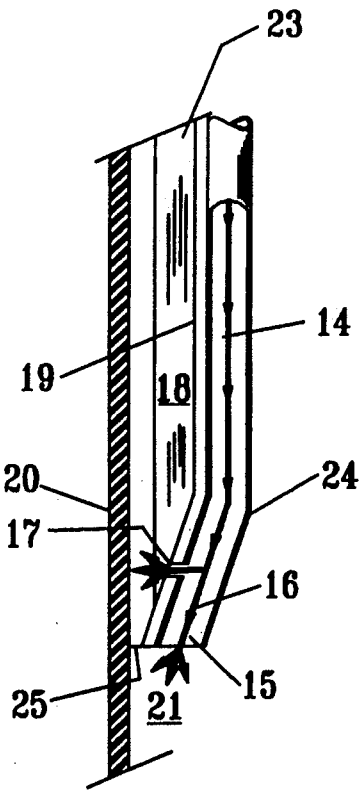
FIG. 1A is an enlarged view of the tapered base of the tool of FIG. 1, illustrating the arrangement of the fluid jet orifices and an exemplary flow of pressurized jetting fluid, all in relation to the conductor pipe.
Figure 1:
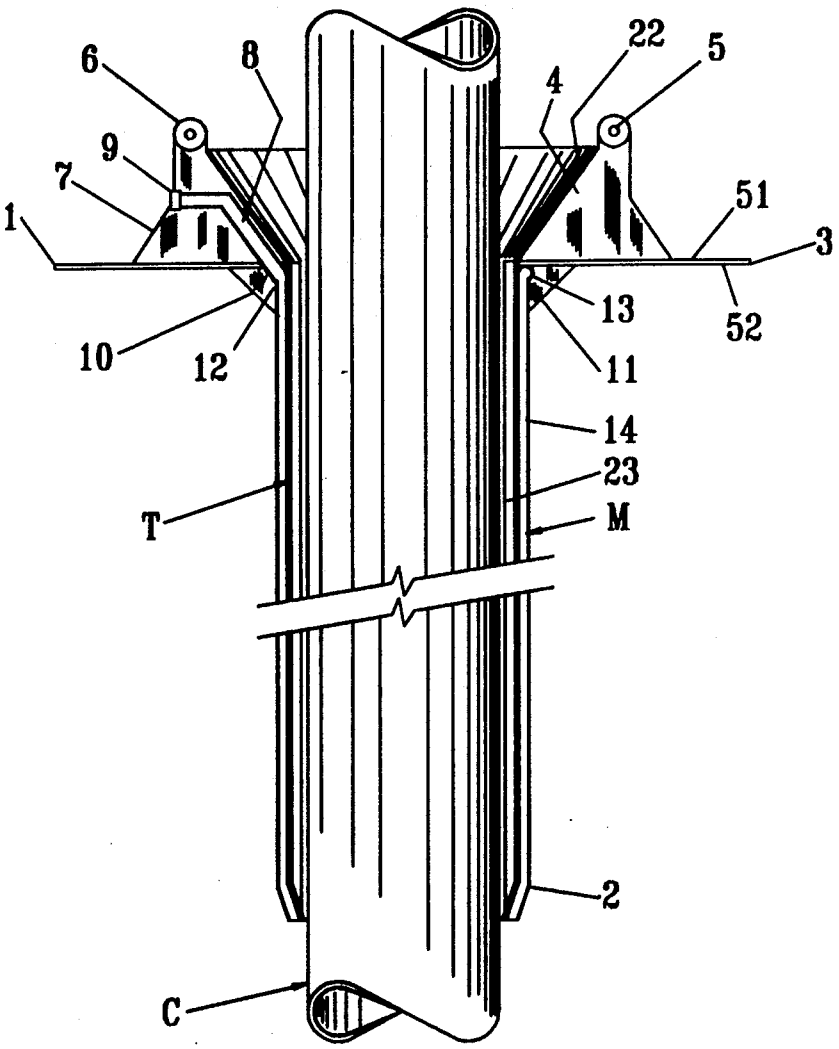
FIG. 1 is a side, partially cross-sectional view of the preferred, exemplary embodiment of the tool of the present invention, illustrating the tool slidingly enveloping an exemplary conductor casing, and illustrating the various component parts of the tool.

As can be seen in FIG. 1, the tool T of the preferred, exemplary embodiment of the present invention, includes a generally cylindrical main body M configured of sufficient diameter to envelope the conductor pipe C which is to be cut, the main body M having a first, upper and second, lower ends 1 & 2, respectively, the first end comprising a base plate 3 having upper and lower sides 51 & 52, respectively. Affixed to the upper side 51 are four gussets 4, 7, (better illustrated in FIG. 2), with each gusset having a lift eye 5, 6, and a bell 22 reinforced by the inner edge 53 of each gusset.

Figure 2:
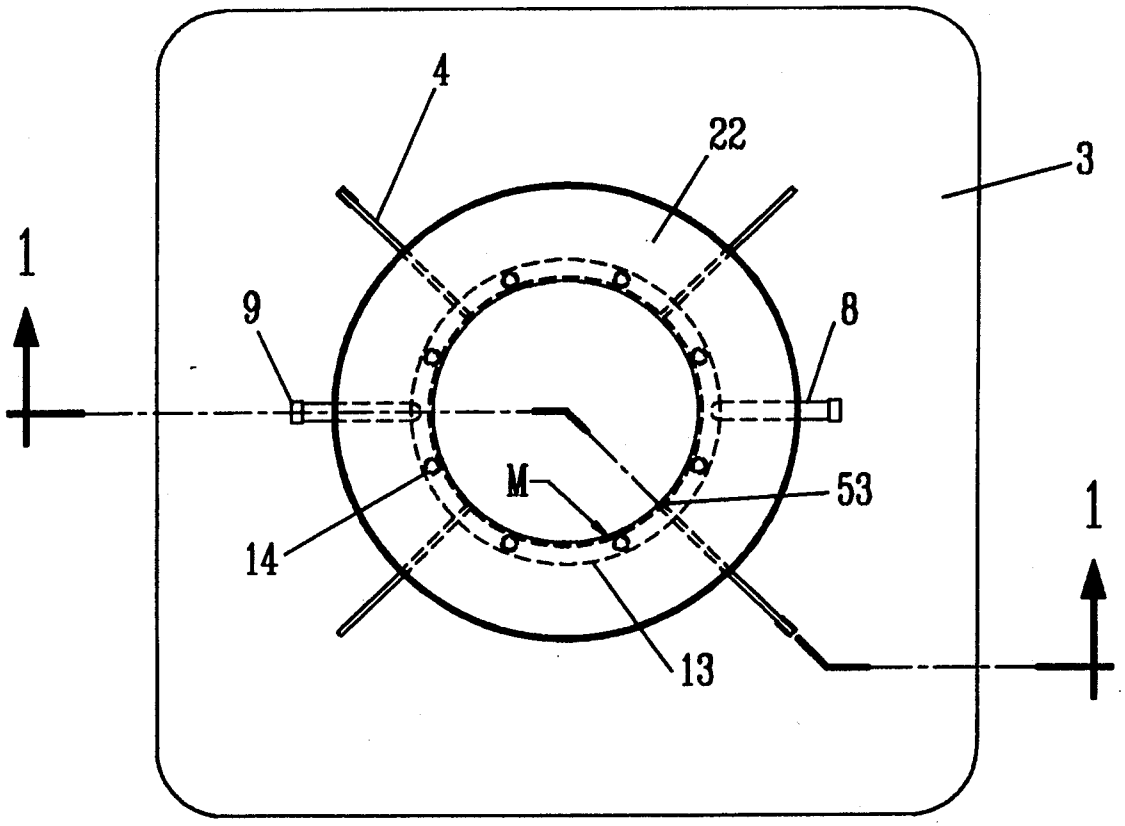
FIG. 2 is a top view of the tool of FIG. 1, illustrating the configuration and arrangement of the jet couplings, the arrangement of the bell and circulation pipes, and the base plate.

Continuing with FIGS. 1 & 2, the first end 1 of the main body M further includes intake tube 8 having an intake coupling 9, with the intake tube 8 communicating with a jet feeder ring 12, 13, which in turn feeds eight, equilateral spaced jet pipes, forming a longitudinal jet feeder array 14, running along the exterior wall of the main body 54 to the second end. Attached to the lower side 52 of the base plate 3 are base support gussets 10, 11, supporting the base plate 3 via the main body M.

Forming the second, lower end 2 is a taper 24 going from wide to narrow, allowing an end clearance on the order of, for example, one-half (½") inch. Formed in the end of the multi-tube longitudinal jet feeder array 14 is a main jet opening 15 wherein there is provided a jetting aperture for releasing pressurized water 21 or the like for excavating soil from about the periphery of the second end 2 of the tool when the tool communicates with the soil in a generally transverse manner.

As shown, inside the tapered area there is formed a circulation cavity 18 between the interior wall 19 of the tool T and the exterior wall of the conductor pipe 20, wherein there is released jetted fluid 16 from the transverse flow orifice 17. Longitudinally affixed along the interior wall 19 of tool T are eight centralizer spacer bars 23 for maintaining uniform spacing between the tool T and the conductor pipe C, as the tool T slidingly envelopes the pipe longitudinally along.

Figure 3:
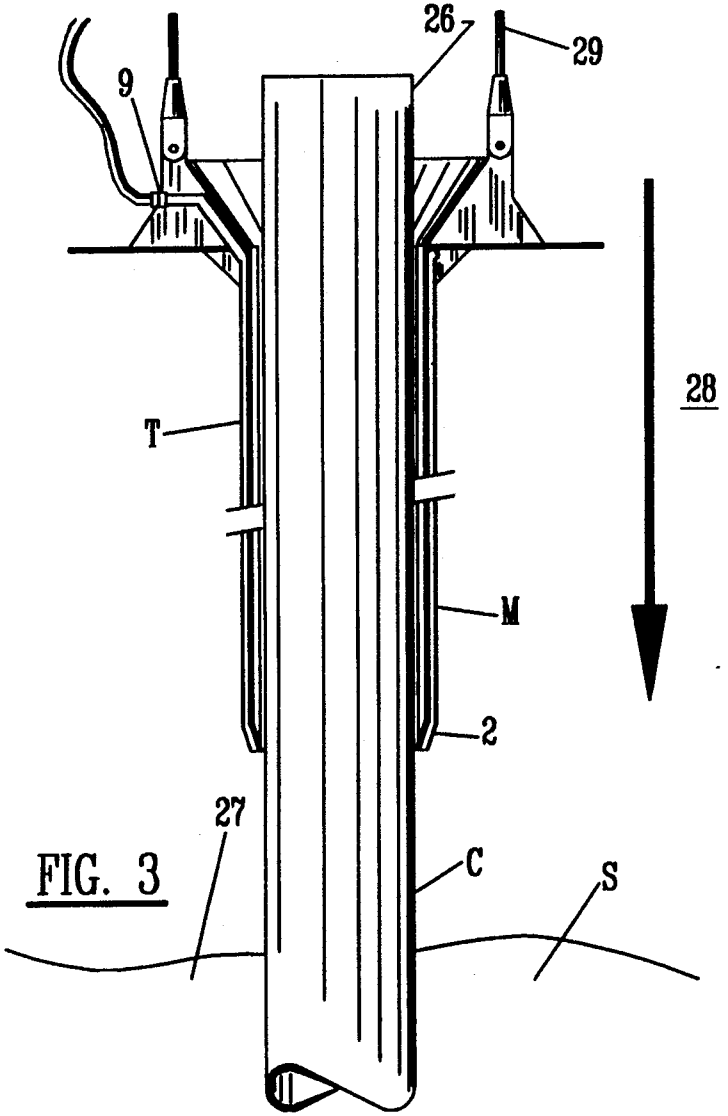
FIG. 3 is a side view of the tool of FIG. 1, wherein there is illustrated a step in the method of utilizing the present system, wherein the tool is slidingly lowered about the conductor pipe via cables until the tapered base communicates with the sea floor.

In use, and as illustrated in FIG. 3, the second, lower end 2 of the main body M of the tool T is lowered (28) via cables 29 or the like about the upper periphery 26 of conductor pipe C, until the second end 2 rests upon the sea floor or ground S.

Figure 4:
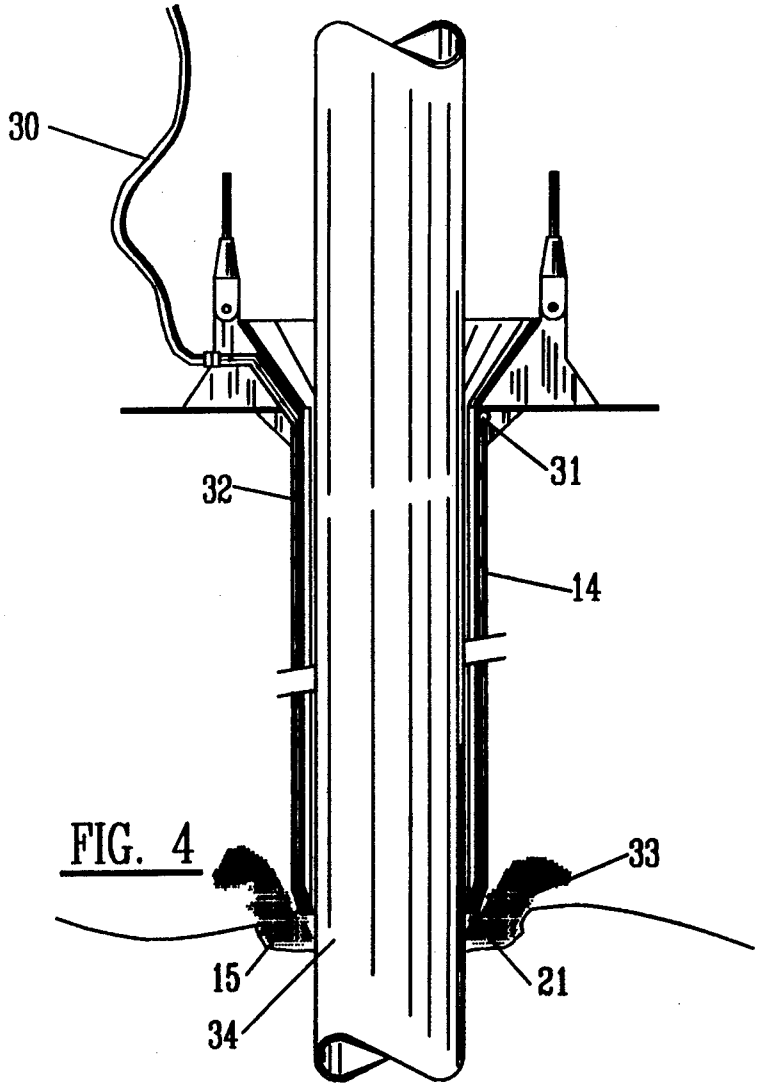
FIG. 4 is a side view of the tool of FIG. 3 illustrating another step wherein a hose is attached to the hose coupling at the top of the tool, and pressurized fluid is jetted about the tapered base periphery of the tool.

After the tool T has been lowered to the base 34 of the conductor pipe, as shown in FIG. 4, hoses 30 are connected to intake couplings 9, the locations of which are more fully illustrated in FIGS. 1, 2 & 4, and high pressure fluid such as water or the like is pumped through hoses 30, intake tube 8, through 31 jet feeder ring 12, 13, and through (32) the multi-tube longitudinal jet feeder array 14, exiting primarily at main jet opening 15, providing a jet flow 21 which initiates the excavation process, dislocating mud 33.

Figure 5:
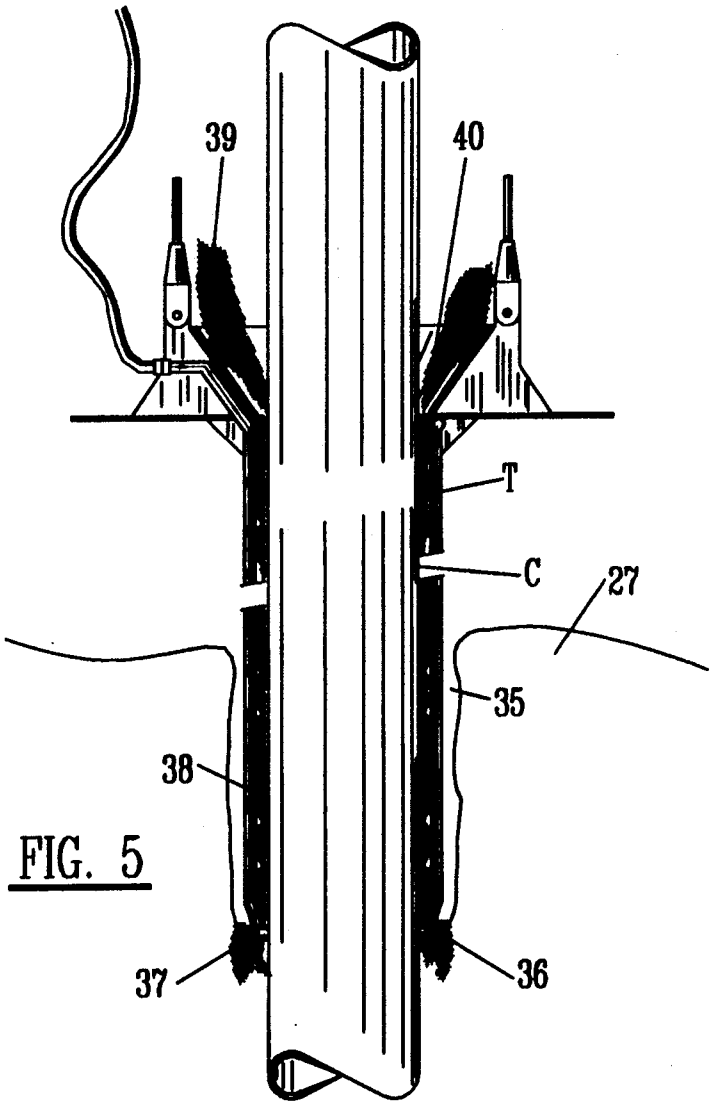
FIG. 5 is another side view of the tool of FIG. 3, wherein the jetting fluid about the base is allowed to excavate and remove the soil from about the periphery of the conductor pipe, lowering said tool about the conductor pipe.

FIG. 5 illustrates the longitudinal migration of the tool T down the conductor pipe C via excavation due to continued jetting. As shown, the high pressure fluid dislocates the mud 37, continually lowering the excavation base 36, increasing the excavation area 35 about the periphery of the conductor pipe C, thereby lowering via gravity the tool T about the pipe to the desired depth.

Referring to FIGS. 1A & 5, as the tool continues to excavate into the mud line 27, an upward, longitudinal circulation current is built up in circulation cavity 18 about the outer periphery of conductor pipe C, encouraged by the transverse flow orifice 17, providing a longitudinal exit circulation of mud and jetting fluid 38, wherein the dislocated mud 37 is ejected (39) via the exit opening 40, consistently spaced via the earlier described centralizer (23) system.

Figure 6:
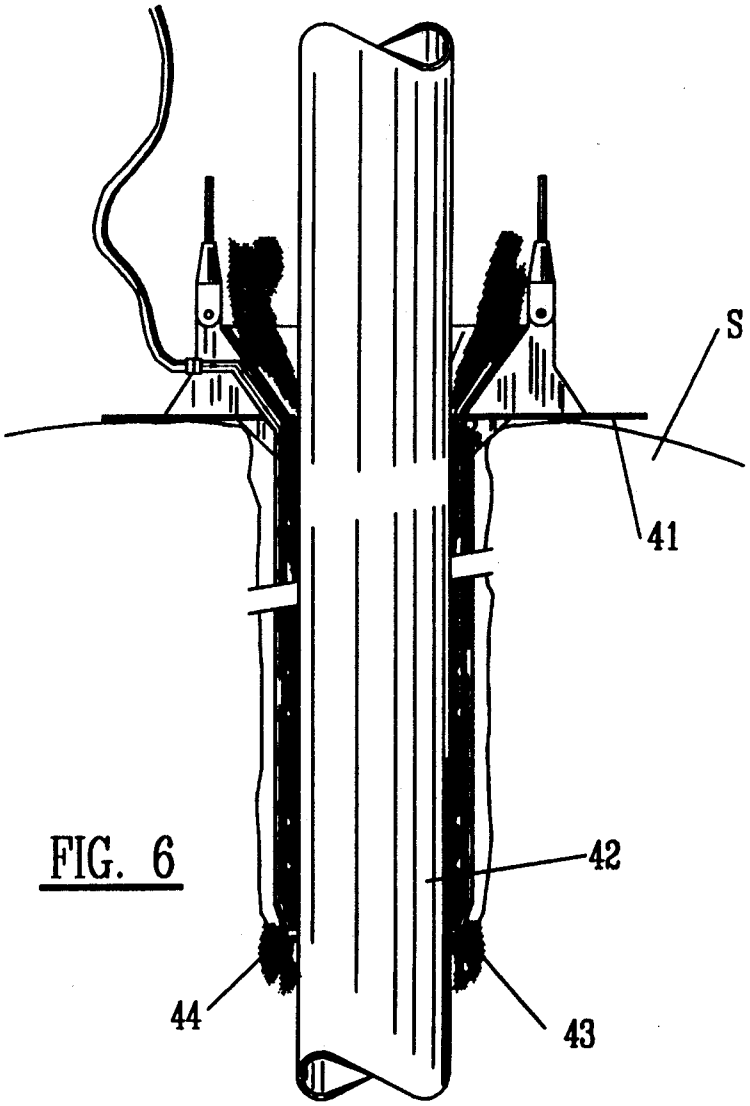
FIG. 6 illustrates yet another side view of the tool of FIG. 3, wherein the excavation of the soil about the pipe continues until the upper base plate intersects with the soil, preventing further longitudinal migration down the pipe.

FIG. 6 illustrates the tool T of the present invention at its fully installed state, wherein excavation and further longitudinal migration is stopped due to the main base plate 41 having come to rest upon the seabed or ground S.

In order to be effective, the tool T must have a main body M length of at least the depth of the conductor pipe cutting area 42, and preferably two or more (2+') feet below the cutting area, for recirculation depth 43.

After the system has reached the recirculation depth 43, the excavation propensity of the present system diminishes, with the jetting fluid and residual soil 44 continuing to circulate (38) and be ejected (39) as described above in the discussion of FIG. 5. At this point, prior to beginning the cutting operation, the fluid is continuing to be jetted through the system, although the fluid pressure may be reduced if desirable.

Figure 7:
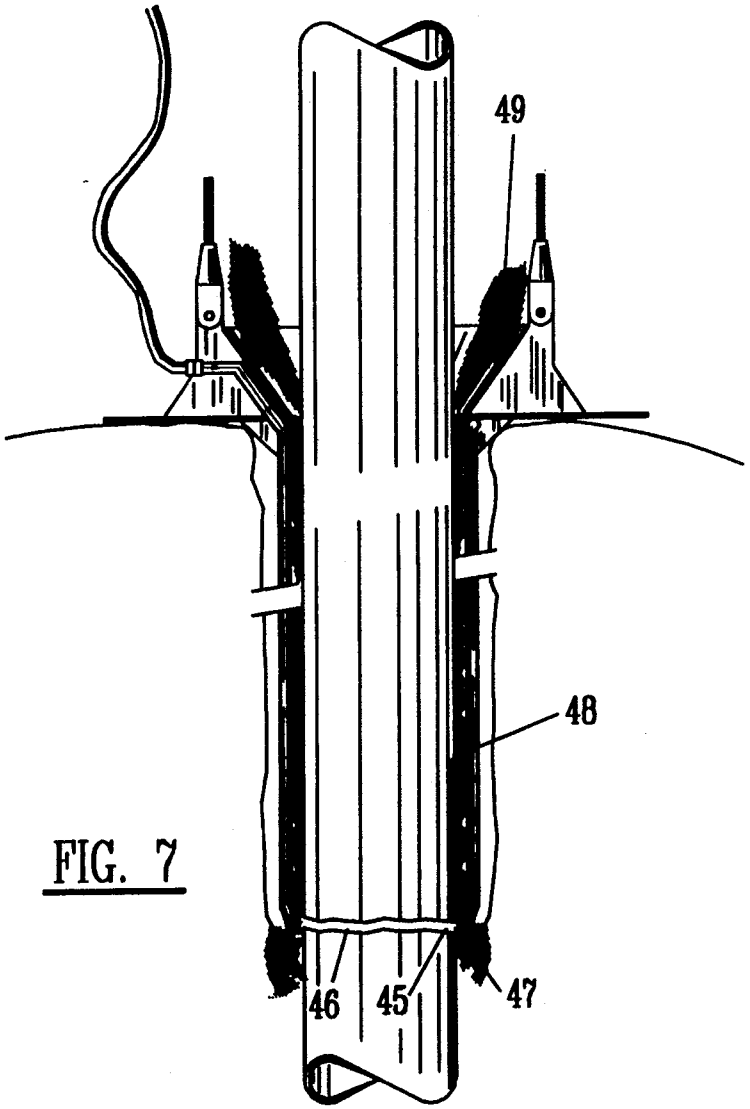
FIG. 7 illustrates still another side view of the tool of FIG. 3, wherein the fluid continues to be jetted about the base, circulating between the exterior wall of the pipe and the tool and venting out of the top of the tool, venting away residual gases generated during the cutting process.

FIG. 7 illustrates the jetting fluid circulation action, which prevents accumulation of the explosive, residual gas pockets 48 formed during the cutting process 45. As shown, the diver has climbed into the conductor pipe to the desired cutting depth, in the present, exemplary case, for example, fifteen feet (15') below the mud line, in order to cut (46) the pipe.

In the cutting operation, the diver utilizes a cutting torch which may release explosive residual gases. As discussed supra, in the past, these residual gases formed in the mud exterior to the pipe, exploding, with sometimes fatal results.

In the present system, however, the gases 48 are safely flushed (48) via the fluid jet circulation up the space between the pipe and enveloping tool, and ejected (49) out of the mud area, much like the excavated material during the installation process, thereby avoiding gas build up and the danger of explosion.

Figure 8:
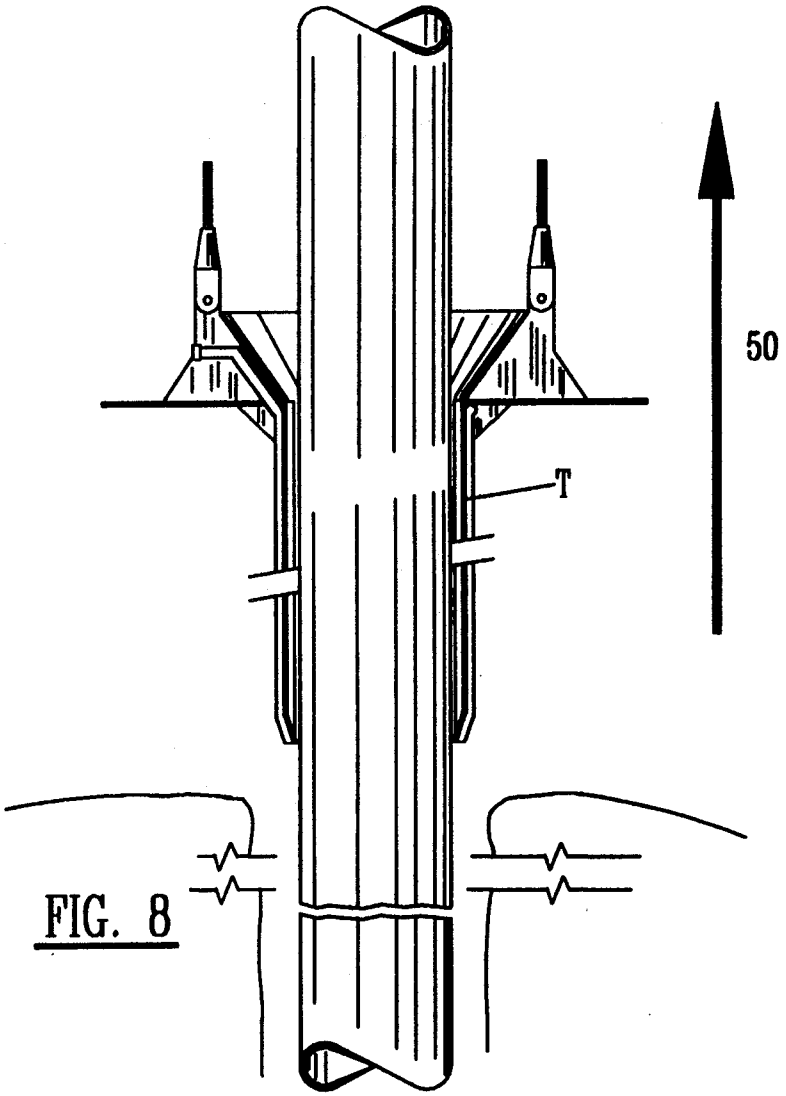
FIG. 8 illustrates another side view of the tool of FIG. 3, wherein following completion of the cutting operation the fluid jetting through the tool is ceased, the hoses removed, and the tool lifted from about the conductor pipe.

After the cutting operation 45 is complete and the pipe severed 46, the fluid flow may be cut and the hose 30 removed and, as shown in FIG. 8, the tool T may be lifted 50, safely and efficiently completing the cutting operation.

| Exemplary Specifications | |
|---|---|
| Conductor pipe - | 30 inches |
| Desired cut - | 15 Feet below mud line. |
| Tool: | |
| Main body M- | 36 inch pipe with ½ inch wall, 18 feet long |
| Hose Coupling 9 - | 2 inch Cam Lock; compatible with Jet Pump |
| Bell 22 - | ½ inch plate |
| Gusset 4, 7 - | ¾ inch plate |
| Base Plate 3 - | ¾ inch plate |
| Jet feeder ring 12, 13 | 2 inch sch 40 pipe rolled to 36 inch ID (+½ inch–0.0 inch) |
| Centralizer 23 - | 1½ × ¼ inch flat bars |
| Jet pipe Array 14 - | 1 inch pipe stick welded to main body M; type of eight total transversely communicating with jet feed ring. |
| Taper 24 - | Bottom ring, roll from ½ plate to 36 inches O.D. at top and 31 inches ID at bottom. Length of taper measured longitudinally - three inches. |

As discussed supra, the system of the present invention is not limited to underwater operations, or the jetting of water or even liquids for circulation, for that matter. The present system and method could be used with similar good results on dry land. Further, the gas removal phase of the operation may be accomplished with fluid gas as opposed to liquid. For example, gaseous nitrogen or similar non-flammable, non-toxic gas may be pumped through the circulation cavity 18 in order to remove residual cutting gasses, preventing buildup, without the heat loss experienced with using water as the circulation medium for above ground applications.

Further, the embodiment(s) described herein in detail for exemplary purposes, and are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A method of cutting an at least partially below ground work piece having a desired cutting area, a longitudinal axis and an outer wall, utilizing a tool configured for preventing the explosive build up of residual gases from the cutting operation in the area surrounding the work piece, comprising the following steps:

(a) providing a tool comprising a main body (M), wherein there is formed a longitudinal cavity therethrough, said main body having a first end (1) and a second end (2), and inner (19) and outer walls, said main body being configured to slidingly envelope the work piece longitudinally, and form a circulation cavity (18) juxtaposed to said inner (19) wall of said main body and the outer wall of the tool, said circulation cavity (18) extending from said second end (2) of said tool out of said first end (1), forming an exit opening (40);

circulation means for providing a flow of non-flammable fluid medium through said circulation cavity (18) and out of said exit opening (40); and a plurality of excavation jets (15) emanating from said second end (2) of said main body (M), said excavation jets 15 configured for jetting a pressured, fluid excavation medium about the periphery of said work piece, displacing the ground about said work piece, and allowing the longitudinal migration of said tool about said work piece;

b. slidingly enveloping the work piece with said tool;

c. initiating a flow of pressurized fluid through said excavation jets;

d. allowing said excavation jets to excavate, displacing the ground about the exterior periphery of said work piece, forming ground particles;

e. initiating said circulation means for directing said displaced ground particles out of the excavation area;

f. allowing said tool to migrate in downward fashion longitudinally about said work piece until the second end (2) of said main body (M) is below the desired cutting area on said work piece;

g. cutting the work piece;

h. releasing flammable gas through said outer wall (20) of said work piece; and i. allowing said circulation means to direct said flammable gas out of the cutting area on said work piece.

2. A method of cutting an at least partially below ground work piece having a desired cutting area and an outer wall, utilizing a tool configured for preventing the explosive build up of residual gases from the cutting operation in the area surrounding the work piece, comprising the following step(s):

(a) providing a tool having an interior and exterior, comprising circulation means for providing a flow of non-flammable fluid medium from the interior of said tool to the exterior of said tool; and at least one excavation jet (15) configured for jetting a pressured, fluid excavation medium about the periphery of said work piece, displacing the ground about the work piece, and allowing the longitudinal migration of said tool about the work piece;

b. slidingly enveloping the work piece with said tool;

c. initiating a flow of pressurized fluid through said excavation jets;

d. allowing said excavation jets to excavate, displacing the ground about the exterior periphery of said work piece, forming ground particles;

e. initiating said circulation means, directing said displaced ground particles out of the excavation area;

f. allowing said tool to migrate in downward fashion longitudinally about said work piece until part of said tool is below the desired cutting area on said work piece;

g. cutting the work piece;

h. releasing flammable gas through said outer wall 20 of said work piece; and i. allowing said circulation means to direct said flammable gas out of the cutting area on said work piece.

3. A method of cutting an at least partially below ground work piece having a desired cutting area, and an outer wall, utilizing a tool configured for preventing the explosive build up of residual gases from the cutting operation in the area surrounding the work piece, comprising the following steps:

a. providing a tool having an interior and exterior, comprising circulation means for providing a flow of non-flammable fluid medium from the interior of said tool to the exterior of said tool;

b. slidingly enveloping the work piece with said tool such that part of said tool is below the desired cutting area of the work piece;

c. initiating said circulation means;

d. cutting the work piece;

e. releasing flammable gas through said outer wall 20 of the work piece; and f. allowing said circulation means to direct the flammable gas out of the cutting area and exterior of said tool.

* * * * *